US006450668B1

(12) United States Patent
Kotloff

(10) Patent No.: US 6,450,668 B1
(45) Date of Patent: Sep. 17, 2002

(54) MULTI-ANGLE LIGHTING FIXTURE

(76) Inventor: Ronald F. Kotloff, 1113 W. Birchwood, Mesa, AZ (US) 85210

( * ) Notice: Subject to any disclaimer, the term of this patent is extended or adjusted under 35 U.S.C. 154(b) by 0 days.

(21) Appl. No.: 09/558,528

(22) Filed: Apr. 26, 2000

(51) Int. Cl.[7] ..... F21V 21/04

(52) U.S. Cl. ..... 362/269; 362/221; 362/260; 362/287; 362/282; 362/283; 362/388

(58) Field of Search ..... 362/221, 260, 362/287, 282, 283, 322, 269, 220, 388

(56) References Cited

U.S. PATENT DOCUMENTS 5,733,036 A * 3/1998 Motgomery ..... 362/283
5,803,585 A * 9/1998 Littman et al. ..... 362/147
6,203,173 B1 * 3/2001 Wanuch et al. ..... 362/260
6,206,548 B1 * 3/2001 Lassovsky ..... 362/283
6,234,643 B1 * 5/2001 Lichon, Jr. ..... 362/147

* cited by examiner

*Primary Examiner*—Sandra O 'Shea
*Assistant Examiner*—Anabel Ton
(74) *Attorney, Agent, or Firm*—Gregory J. Nelson

(57) ABSTRACT

A luminaire-style lighting fixture having a central housing with a pair of lamp supporting reflector panels pivotally secured to opposite sides of the housing. The panels may be positioned in selected angular positions to vary the effective illuminated area and to provide access to the housing. In a preferred embodiment, the panels are secured in one of said selected positions by detent mechanisms.

6 Claims, 3 Drawing Sheets

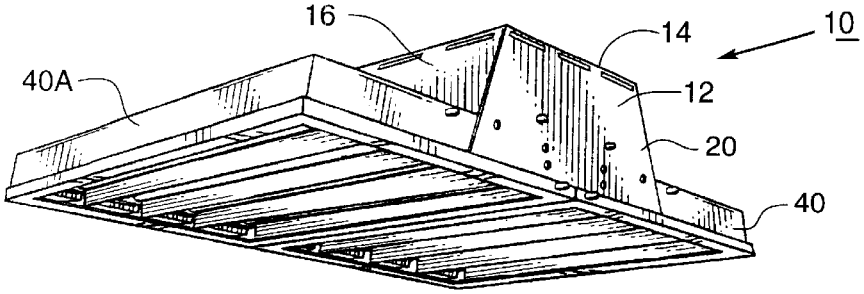
FIG.. 1.
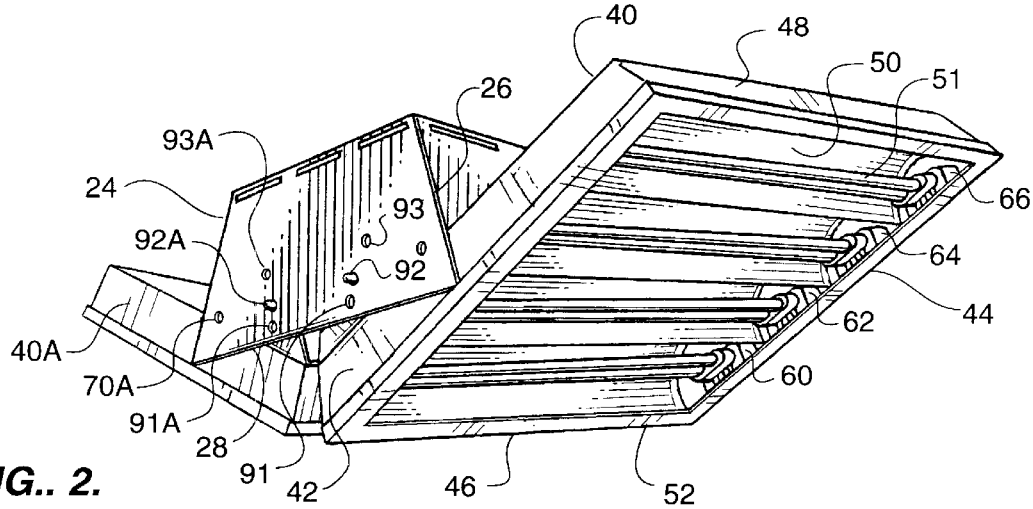
FIG.. 2.
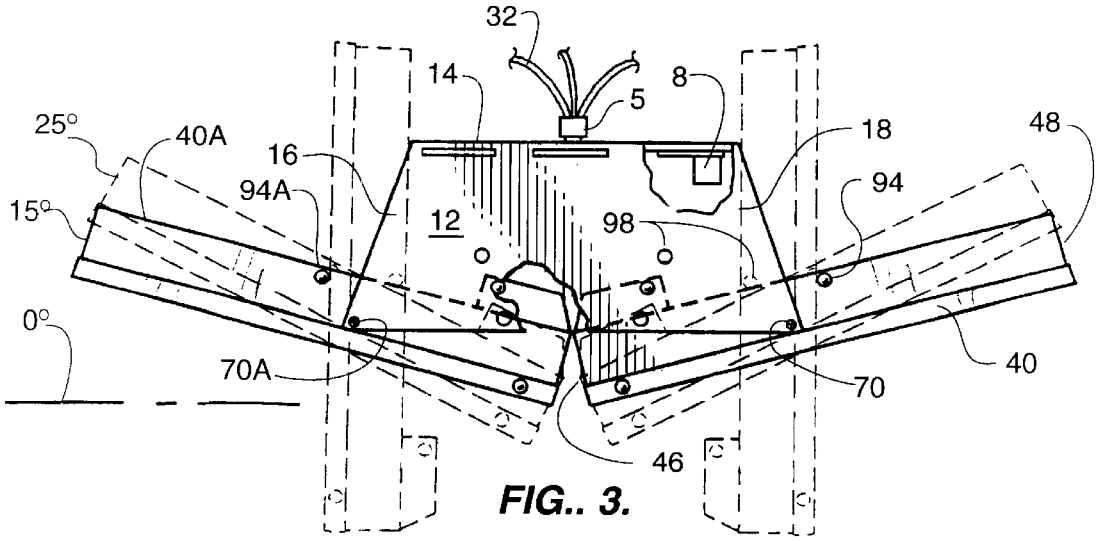
FIG.. 3.

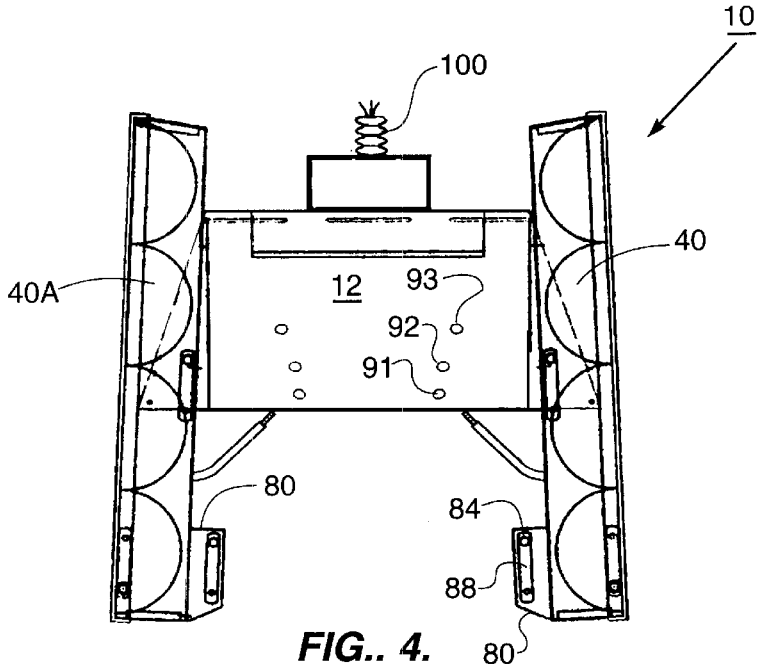
FIG.. 4.
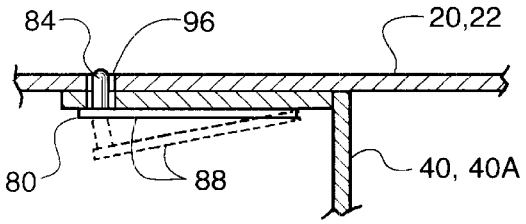
FIG.. 7.
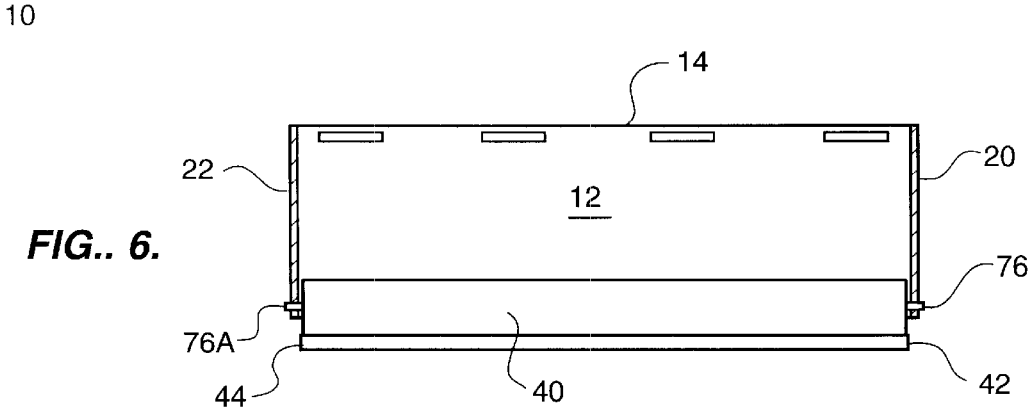
FIG.. 6.

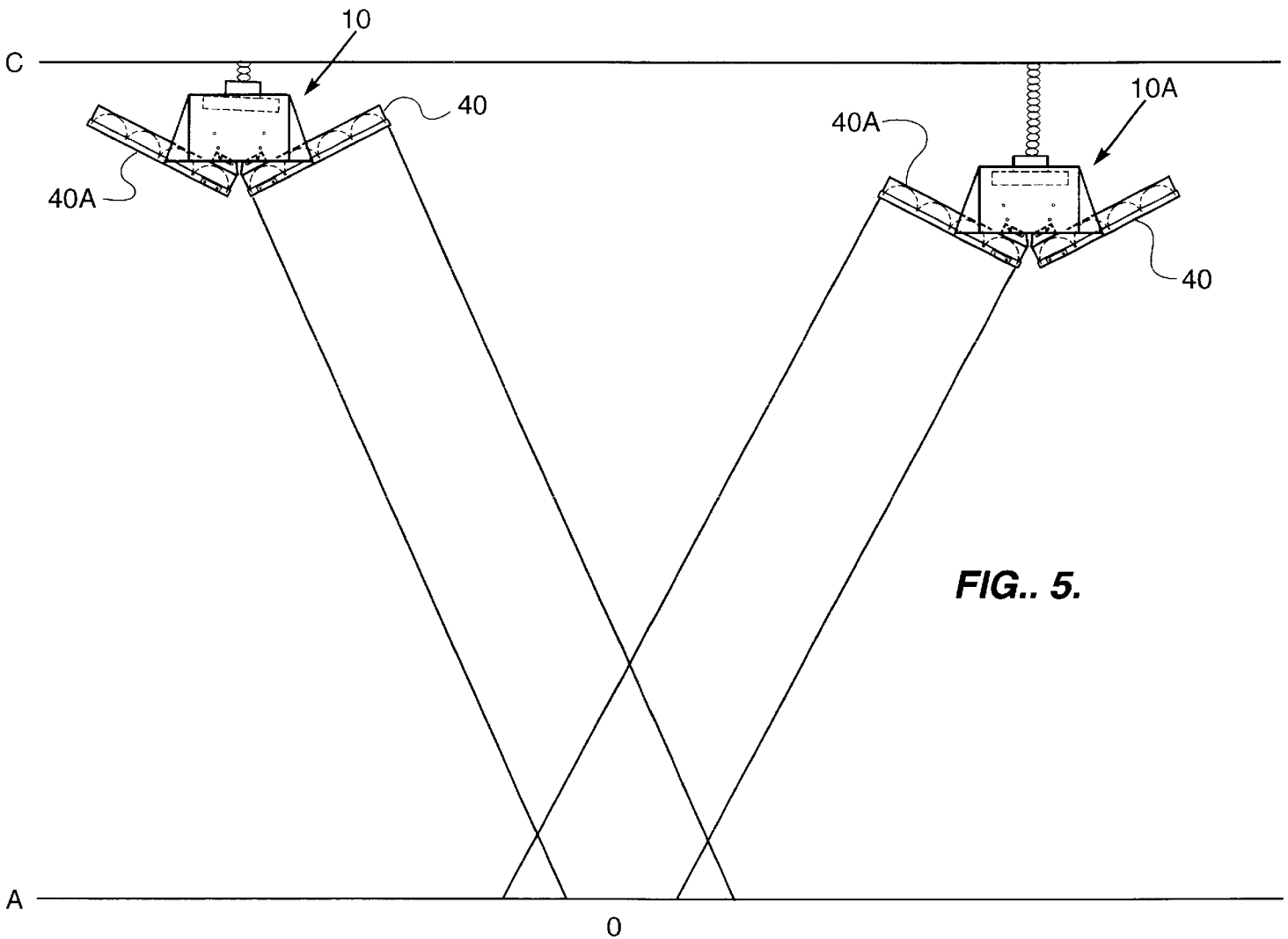
FIG.. 5.

MULTI-ANGLE LIGHTING FIXTURE

FIELD OF THE INVENTION

The present invention relates to lighting fixtures and more particularly relates to lighting fixtures or luminaires having one or more lamp supporting reflector panels which are angularly adjustable to vary the effective lighted area.

BACKGROUND OF THE INVENTION

Areas such as retail stores, warehouses, commercial buildings and the like are illuminated by various types of lighting fixtures. Typical lighting fixtures are suspended from the ceiling and house lamps such as mercury vapor, metal halide or sodium lamps. One type of fixture used in these environments is the high intensity discharge (HID) fixture, which typically includes a single light source with a dome and reflector about the lamp which reflects the light. The reflector is generally a highly polished metal, or in some cases may be plastic, having a reflective and refractive characteristics. Such high intensity discharge lamp fixtures are effective but generally require high power requirements operating in the range of 400 to 1000 watts of power.

Many commercial lighting installations utilize fluorescent lamp fixtures termed "luminaires" because of their low wattage requirement. Generally commercial fluorescent lighting fixtures utilize fluorescent tubes normally 4 to 8 feet in length. The tubes are generally placed in housings which are positioned in the ceiling or suspended from the ceiling in the area to be illuminated. While use of this type of lighting fixture reduce power consumption, lighting of this type may require a substantial number of luminaries to produce the level of illumination necessary. This is particularly the case in buildings such as warehouses, which have high ceilings necessary to accommodate high stacking and shelving of items.

There have been a number of recent developments in the area of lighting technology which provide the advantage of conventional fluorescent lighting devices and reduce power requirements. These improved devices, known as compact fluorescent, replace HID fixtures, as well as conventional fluorescent fixtures. The newer fluorescent devices utilize compact fluorescent tubes and generally comprise two elongated tubes of shorter length which are connected in a "U" at their outer end. The inner ends of the tubes are provided with a plug which is received in a socket in the fixture. These devices can be arranged in various configurations, either in parallel or arranged in a circular array. Compact lamps of this general type are sold under various brand names such as Biax, Dulux-L and PLL, and typically are 40 or 50 watts.

SUMMARY OF THE INVENTION

It is a primary objective of this present invention to provide an improved lighting fixture which may utilize either conventional fluorescent light tubes or newer compact fluorescent light tubes which fixture has adjustable light supporting reflector panels which can be angularly positioned to vary the effective area which is illuminated.

In accordance with a preferred embodiment of the present invention, the lighting fixture has a central ballast housing with opposed end walls. At least one reflector panel is pivotally secured to the ballast housing. A button-type detent is secured to the frame of the reflector panel and may be placed in registry with holes in the housing to adjust the angular position the reflector panel with respect to the area to be lighted. For example, the reflector panel may be disposed in a generally horizontal position or may be angularly positioned at selected angles with respect to the area being illuminated.

The reflector panel houses one or more lamps such as conventional fluorescent lamps or compact fluorescent lamps. For shipping and servicing, the reflector panel may be pivoted to a position in which it abuts the sides of the ballast housing. Once installed, positioning the reflector panel in a position along side the ballast housing, places the reflector panel in a generally vertical position allowing convenient access to the ballast housing for service and maintenance. The angular position of the panel with respect to the ballast housing can be easily adjusted by means of the detent arrangement without requiring any special tools. Adjustment of the angular position of the reflector panel varies the effective illuminated area of the fixture and has particular application in lighting aisles in high bay applications.

In a preferred embodiment, the lighting fixture comprises a pair of reflector panels adjustably mounted at opposite sides of the ballast housing.

BRIEF DESCRIPTION OF THE DRAWINGS

The above and other objects of the present invention will become more apparent from the following description, claims and drawings in which:

FIG. 1 is a perspective view showing the lighting fixture of the present invention in a position which the reflector panels are disposed horizontally;

FIG. 2 is a view similar to FIG. 1 showing the reflector panels pivoted to an angular orientation which would be utilized to light an area, such as a long aisle;

FIG. 3 is an end view of the lighting fixture of the present invention showing various positions of the reflector panels in dotted lines;

FIG. 4 is an end view similar to FIG. 3 showing the reflector panels positioned in a maintenance position to provide convenient access to the interior of the ballast housing;

FIG. 5 illustrates typical installation such as installation of the lighting fixture in a high bay long aisle application as may occur in a warehouse or similar environment;

FIG. 6 is a side view of the lighting fixture shown with the reflector panel in a horizontal position; and FIG. 7 is a detail view of the detent for securing a reflector panel in a selected position.

DETAILED DESCRIPTION OF THE DRAWINGS

Turning now to FIGS. 1 to 4, in which the same reference numerals are used throughout the various drawing figures to designate the same or similar elements, a the lighting fixture according to the present invention, which fixture is shown and is generally designated by the numeral 10. Lighting fixture 10 includes a center ballast housing 12 formed of a galvanized steel or similar material. The ballast housing 12 has a generally rectangular top wall 14 and opposite side walls 16 and 18. The housing enclosure is completed end walls 20, 22. It will be noted that end walls 20, 22 each diverge outwardly and extend below the side walls 16 and 18. The end walls are shown having bottom edge 28 extends between the outwardly diverging side edges 24 and 26.

The ballast housing 12 encloses a plurality of ballasts B that are secured to the top 14. The ballasts B are connected to a source of power, such as a 110 VAC power source by means of power cords 32. The number of ballasts may vary, but generally a single ballast will operate or control two or more lamps. It is preferable that the power to the ballast is connected through a day light harvesting system, which will control the operation of the fixture by turning the power off to the fixture during periods of sufficient natural light.

A pair of reflector panels 40 and 40A are pivotally secured to the ballast housing. The reflector panels 40 and 40A are similarly constructed. It will also be apparent that the lighting fixture of the present invention may be provided with only a single reflector panel, but for optimum convenience and efficiency two panels are preferred. Each reflector panel 40 and 40A has opposite end walls 42, 44 and opposite side walls 46 and 48 forming a generally rectangular frame. A reflector 50 of polished aluminum or similar enhanced reflective material extends across the top of the reflector panel. The reflector 50 defines a plurality of arcuate channels 51 extending between the end walls 42, 44. The bottom of the panel is open being defined by a peripheral lip 52, as is conventional. A lens may be inserted within the panel and secured in position by the lip 52. Alternatively, a guard screen may be positioned in the frame to protect the lamps from damage.

A plurality of sockets 60, 62, 64 and 66 are located at the interior of end wall 44. The sockets may be of the type as manufactured by Mellart or Biax, each defining slots to receive the pins of a lamp 66. The lamps 66 are preferably of the compact fluorescent-type such as high output 40 or 55 watt fluorescent lamps of the type manufactured by Osram/Sylvania, Philips or GE and are each located within one of the reflector channels 51 of reflector 50. The sockets 60, 62, 64 and 64A are electrically connected to a ballast B.

The ballast housing end walls 20, 22 each define a pair of pivot bores 70 and 70A, which are spaced-apart and located adjacent the edges 24 and 26. The side walls 42 and 44 of the reflector panel 40 each carry a projecting pivot pin 76, which are received within pivot bore 70S. Reflector panel 40A is provided with similar pivot pins 76, 76A received within pivot bores 70A at the end walls 20, 22. Thus, the reflector panels 40, 40A each pivot with respect to the housing.

The angular positioning of the panels 40 and 40A with respect to the ballast housing is accommodated by a detent arrangement. Each of the panels carries a pair of detent plates 80, which are located near the inner side wall 42 of the reflector panel projecting from the upper edge of end walls 42 and 44. As best seen in FIG. 7, each of the detent plates carries a detent button 84 which projects through a hole 86 in the associated plate. The opposite end of the button is secured to a leaf-like spring member 88 which allows the button to be depressed, but which will normally urge the pin to a position extending through the hole 86 in the plate 80. As will be explained below, the detent button may be placed in registry with a detent bore to position the reflector in a selected angular position.

The ballast housing end plates 20, 22 each carry a plurality of bores arranged along a arcuate path. Any convenient number of bores may be provided and three bores 91, 92 and 93 are shown positioned to align with the detent buttons on reflector panel 40. Similarly, bores 91A, 92A and 93A are positioned to be registerable with the detent button on panel 40A. The number and spacing of holes may vary to some extent depending upon the application. However, it is preferred that detent holes 91 and 91A be located so that when the detent button on panels 40, 40A is in registry with these holes, the associated reflector panel is in a generally horizontal position. To reposition the reflector panel, the detent buttons 84 can be manually depressed inwardly as shown in dotted lines in FIG. 7 to allow the panel to be pivoted aligning the button with a selective other of the detent bore such as bores 92, 92A, 93, 93A.

Bores 92, 92A are located so as to position the associated reflector panel at an angle of about 15° with respect to horizontal as best seen in FIG. 3. Positioning the detent buttons in the lower holes 93, 93A will orient or position the deflector panels 40, 40A an angle such as approximately 25°, with respect to horizontal. If the detent buttons associated with the panel are disengaged, the panels will assume a normal suspended position generally vertical as shown in dotted lines in FIG. 3. In this position, access to the interior of the ballast housing for maintenance. A detent may be provided to secure the panels in the general vertical maintenance orientation. As seen in FIG. 3, buttons 94, 94A may be placed in registry with bores 98, 98A to secure the panels in a vertical position for shipping, storage or maintenance.

Other means for securing the reflector panels in selected positions may be employed. For example, screws or other fasteners extending between the ballast end wall and the reflector frame may be used to secure the reflector in a selected position.

In use, the fixtures may be secured by either a chain 100 or pendant mounting to a ceiling in an area to be illuminated. As pointed out above, the lighting fixture of the present invention has particular application in lighting environments such as warehouses which have high ceilings and long, narrow aisles, which are to be lighted. FIG. 5 illustrates such an installation. A pair of lighting fixtures 10, 10A according to the present invention are shown installed suspended from the ceiling "C" of a warehouse. The fixtures 10 and 10A are spaced-apart a distance and are connected to a suitable source of power. The fixtures are positioned to illuminate the long aisle A and accordingly, the reflector panels have each been adjusted to an angle of about 25° to increase the maximum length of the aisle illuminated by a single fixture. Preferably some overlap, as in the area O, occurs so that there are no unlighted or dimly lighted areas in the aisle. A significant advantage of the fixture of the present invention is that the angular position of the reflectors or luminaries can be adjusted in accordance with the installation requirements. If a lesser length of the aisle A is to be illuminated, the position of the reflector frames to the ballast housing can be easily adjusted without tools by the technicians simply depressing the detent buttons to allow the reflector panels to be pivoted to another angle or position, or a horizontal position. The reflector 50 within the panels will direct the light so as to minimize dark spots and provide uniform illumination.

The adjustability of the reflector panels provides great versatility. Easy access to the lamps and ballast is accommodated without the use of tools. The fixture may also easily be shipped in a position in which the reflector panels are placed generally perpendicular to the ballast housing in order to occupy minimum space.

Tests have shown that the lighting fixture of the present invention result in substantial savings to the user, both in terms of operational costs and initial installation costs. In some installations, a single fixture of the type described above can be used to replace two or more conventional fluorescent fixtures. Maintenance is also easier and safer as maintenance technicians can easily access the interior of the ballast housing without having to utilize tools to remove screws or other fasteners, which can present dangerous situations particularly if individuals are working on a high ladder or scaffold.

As pointed out above, the system can be used with various control circuits as for example circuits "S" that achieve daylight harvesting. Daylight harvesting occurs when lamps within the fixture are progressively switched on and off as required depending upon ambient like conditions. For example, if the fixture of the present invention is used in an indoor warehouse area, lamps would generally be switched on two at a time as darkness progresses. Similarly, as natural light is available through skylights or the like, the lamps will be switched off in pairs until all the lamps have been switched off when sufficient daylight exists so that artificial lighting is not required.

It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. A lighting fixture comprising:

(a) a housing;

(b) a first reflector panel having a frame, said frame supporting at least one socket for reception of a lamp, said first reflector panel being pivotally secured to said housing and having pivotal positions between a generally horizontal and a generally vertical position;

(c) first positioning means for securing said first reflector panel in a selected pivotal position relative to said housing;

(d) a second reflector panel having a frame, said frame supporting at least one socket for reception of a lamp, said second reflector panel being secured to said housing adjacent said first reflector panel and having pivotal positions extending between a generally horizontal and a generally vertical position; and (e) second positioning means for securing said second reflector panel in a selected pivotal position relative to said housing.

2. The lighting fixture of claim 1 wherein said lamps are compact, flourescent lamps.

3. The lighting fixture of claim 1 wherein said housing is generally open at the bottom and further including third positioning means for securing said reflector panels in said vertical position.

4. The lighting fixture of claim 3 wherein said first, second and third positioning means for securing said first and second reflector panels comprises detent means.

5. The lighting fixture of claim 4 wherein said detent means each comprises a plurality of holes in said housing and a spring-biased button on said panel registerable with a selected of said holes.

6. A lighting fixture comprising:

(a) a housing having a generally open bottom with opposite sides and ends wherein said housing ends extend outwardly and downwardly from said housing sides;

(b) a first reflector panel having a frame, said frame supporting at least one socket for reception of a lamp, said first reflector panel being pivotally secured to said housing ends and being pivotal between a generally horizontal and a generally vertical position and first positioning means for securing said first reflector panel in a selected pivotal position;

(c) a second reflector panel having a frame, said frame supporting at least one socket for reception of a lamp, said reflector panel being pivotally secured to said housing adjacent said first reflector panel and being pivotal between a generally horizontal and a generally vertical position and second positioning means for securing said second reflector panel in selected pivotal position;

(d) said housing including third positioning means associated with each of said first and second reflector panels for securing said reflector panels in said vertical positions;

(e) said first, second and third positioning means for securing said first and second reflector panels comprises detent means; and (f) wherein detent means each comprises a plurality of holes in said housing and a spring-biased button on said panel registerable with a selected of said holes.

* * * * *